US012644377B2

(12) United States Patent
Shokanov

(10) Patent No.: US 12,644,377 B2
(45) Date of Patent: Jun. 2, 2026

(54) METHOD OF USING NON-MAGNETIC SOLID TRACERS

(71) Applicant: Talgat Shokanov, Houston, TX (US)

(72) Inventor: Talgat Shokanov, Houston, TX (US)

( * ) Notice: Subject to any disclaimer, the term of this patent is extended or adjusted under 35 U.S.C. 154(b) by 0 days.

(21) Appl. No.: 18/953,826

(22) Filed: Nov. 20, 2024

(65) Prior Publication Data

US 2025/0075617 A1 Mar. 6, 2025

Related U.S. Application Data

(63) Continuation-in-part of application No. 17/688,316, filed on Mar. 7, 2022, now abandoned.

(51) Int. Cl.
*E21B 47/11* (2012.01)

(52) U.S. Cl.
CPC ..... *E21B 47/11* (2020.05)

(58) Field of Classification Search
CPC ... E21B 47/11; E21B 47/111; G01N 21/6428; G01N 2021/6439; G01N 2021/6484
USPC ..... 166/250.01, 250.12
See application file for complete search history.

(56) References Cited

U.S. PATENT DOCUMENTS

2010/0314108 A1* 12/2010 Crews ..... C09K 8/516 507/275
2013/0044858 A1* 2/2013 Allen ..... G01N 23/223 378/208
2013/0245953 A1* 9/2013 Gonzales ..... E21B 47/103 702/13
2014/0198898 A1* 7/2014 Beumer ..... G01N 33/2823 378/47
2015/0293007 A1* 10/2015 Ramakrishnan ..... G01N 15/088 73/38
2016/0075937 A1* 3/2016 Cannan ..... C09K 8/80 166/250.1
2022/0251252 A1* 8/2022 Bareket ..... C08F 8/42
2022/0276217 A1* 9/2022 Schimmel ..... E21B 47/06
2023/0160298 A1* 5/2023 Abbad ..... E21B 47/11 702/6

FOREIGN PATENT DOCUMENTS

CN 107740690 A * 2/2018 ..... E21B 49/088

OTHER PUBLICATIONS

Translation of CN 107740690 A (Year: 2018).*

* cited by examiner

*Primary Examiner* — Angela M DiTrani Leff
(74) *Attorney, Agent, or Firm* — Kearney, McWilliams & Davis, PLLC; John M. DeBoer

(57) ABSTRACT

A method of using a tracer additive in a wellbore that includes forming a utility fluid mixture comprising the tracer additive, and disposing the utility fluid into the wellbore so that the utility fluid comes into contact with a target formation. Upon contacting the utility fluid with the target formation for an amount of time, returning a remnant fluid that includes at least a portion of the utility fluid to a surface for testing. The tracer additive has a first composition, and is in a solid non-magnetic powder.

7 Claims, 6 Drawing Sheets

METHOD OF USING NON-MAGNETIC SOLID TRACERS

BACKGROUND

Field of the Disclosure

This disclosure generally relates to the use of an innovative type of chemical additive known as a 'tracer' in a wellbore, or other formations such as a subsurface reservoir. The tracer may be pumped into the wellbore with existing multistage hydraulic fracturing or subsurface injection process and flown out from the targeted wellbore or at the offset wells. A resultant produced fluid may then be tested in manner that facilitates determination of flow performance, inter-well communication, or a model of one or more production parameters associated with the wellbore, created hydraulic fractures, and/or reservoir production performance. The disclosure relates to subsurface flow mapping and (A.I.-assisted) completion optimization using ultrahigh resolution nano particle tracer technology in oil and gas wells, subsurface injection for production enhancement and disposal, and geothermal projects.

Background of the Disclosure

A hydrocarbon-based economy and an emerging geothermal power supply continue to be dominant force in the modern world. As such, locating and producing hydrocarbons continues, along with understanding the flow performance of subsurface formations, demand attention from the oil and gas (O&G) industry. A well or wellbore is generally drilled in order to recover valuable hydrocarbons and other desirable materials trapped in geological formations in the Earth, which are later refined into commercial products, such as gasoline or natural gas.

A wellbore is typically drilled using a drill bit attached to the lower end of a "drill string." Once the drilling is finished, a production string is typically placed all the way into the wellbore. To gain access to hydrocarbons, selected portions of the production string (and formation) are often perforated. Common today to increase or enhance production in the tight or unconventional reservoirs is the use of multistage hydraulic fracturing (i.e., "fracing") in the surrounding formations.

Fracing entails the pumping of fracturing fluids with sand into a formation in an open-hole or via perforations in a cased wellbore or other openings in the casing to form a fracture(s) in the formation. Fracing routinely requires very high fluid pressure and pumping rate and can occur in a multistage fracing manner. The well construction design may entail an open hole, cased hole, lined hole, etc.

The modern design of shale well with multi-stage hydraulic fracturing operations involve pumping from 20 to 100 fracing stages with a cumulative volume of 5 to 20 million gallons of water and from 5 to 20 million pounds of sand per well. This represents the total cost ranging from 4.0 million to 9.5 million U.S. dollars per well.

Approximately 7,000 horizontal wells were drilled, and 250,000 stages completed in North America alone in 2020. Additionally, current multi-stage fracing operations are still expensive, increasingly environmentally challenging and emissions intensive. Multi-stage fracing operations already represent up to 70% of the total cost for each well. If current trends of increasing horizontal lateral length and adding more stages per well continue using current brute force approach, it is estimated that up to 25% of new wells will be uneconomical.

Fracing or other forms of production stimulation methods such as Improved Oil Recovery (IOR) and Enhanced Oil Recovery (EOR) are typically used in either conventional or unconventional wellbores. The difference between what is commonly understood as conventional or unconventional relates to rock permeability, or rather, how tight the rock/formation is. Unconventional wells also tend to have vast and unpredictable formation variation (reservoir quality), and receive less attention, as profitability is often reduced or limited as a result of higher costs associated with well construction, fracing, and fast production decline.

In the event of dealing with an unconventional (or even conventional) well, production diagnostic tools may be used in order to predict well performance, improve well design, or aid in future well development. Typically, diagnostic or surveillance tools include fiber, PLT (production logging), fiber-optic, and liquid chemical tracers.

Use of fiber optic systems that include distributed acoustic sensing (DAS) and distributed temperature surveys (DTS) is known to provide high-end diagnostic results. However, fiber is known to be excessive in cost and deployment complexities, and the time to obtain useful data may be in the realm of weeks or longer. Depending on the complexity, the installation of fiber optic DAS and DTS systems can add as much as $1 million/well to the completed total costs.

PLT also has its favored uses and is a historically well accepted approach, but while perhaps slightly lower in cost, it is known to provide a very short snapshot view and information compared to fiber and requires well shut-in and costly wireline intervention.

Conventional chemical liquid tracers that are dissolvable in oil or water have enjoyed success but are also known to have limitations. These tracers are dissolvable in oil and water phases, and typically have fluorescent properties, DNA and ionic, organic materials, or radioactive diagnostic isotopes. Such tracers are used to evaluate fracturing performance, ostensibly to control the effectiveness of multistage hydraulic fracturing stimulation. Owing to obvious environmental deficiencies, tracers incorporating radioactive isotopes have largely fallen out of favor. Given their soluble characteristics, conventional chemical tracers must be tailored for individual fluid types, thereby requiring more, and often exotic, formulations for a single stage, increasing the chemical tracer costs appreciably.

Given the inherent heterogeneity of the rock along a typical horizontal lateral (i.e., horizontal wellbore) and the assorted fluid streams, the different types of liquid chemical tracers required could add up significantly in incremental costs/well. Furthermore, once liquid-based tracers have been pumped, they disseminate quickly and flush from the proppant pack, shortening the effective monitoring period significantly. Thus, between occasionally inconclusive accuracy, cross-well contamination, and downhole temperature restrictions (limited to 400 F), the use of contemporary liquid tracers is limited.

In the same vein, conventional tracer testing is severely restricted by the time required to obtain a comprehensive interpretation of the test results. This is normally accomplished from an offsite lab with a minimum three-week turnaround on average, given the longer sample preparation time, very expensive instrumentation, sensitive samples dissolution process and specialized argon gas and reagents needed for analysis Perhaps one of the more glaring drawbacks with liquid tracers is the limitation to only chemical measurement techniques at a molecular level, and the frequent instigation of unnecessary signals to what is erroneously perceived as "frac-hits". A frac hit is typically described as a fracture-driven inter-well communication event where an offset well, often termed a parent well in this setting, is affected by the pumping of a frac treatment in a new well, called the child well.

Each of the aforementioned techniques: fiber, PLT, and liquid chemical tracer tools have temperature limitations (i.e., for use in <700° F.) that make their use problematic at best in unconventional reservoirs as well as geothermal formations, where temperatures may be as high as 800° F.

The industry needs a low-cost, stage-by-stage flow profiling method that can be used for assessing unconventional reservoirs quality, the completion designs, and to advance the multi-stage fracing diagnostics to the next level.

Moreover, reducing emissions and environmental footprint from multi-stage hydraulic fracturing operations is a high-priority metric in oil and gas, as operators staunchly embraced environmental, social and governance (ESG) initiatives. In addition, fracture-driven interactions between fractures of the new wells (i.e., child wells) with adjacent horizontal wells (i.e., parent wells) and their costly negative effects have become the focus of much discussion and debate within the technical community. The negative impact of these frac-to-frac interactions on well productivity, including a rapid drop in production, poor well economics and the mechanical integrity of these parent wells, was the driving force behind such attention.

The need for a novel ultrahigh resolution nanoparticle tracer that is versatile, affordable, highly accurate, non-radioactive, non-intrusive and quick to test is increasing as never before for all subsurface, production and injection applications.

Thus, there is an urgent need to have accurate, affordable, timely data on the performance of individual stages, measured intra-well and frac-to-frac communication. What is needed is a new and improved way of forming and using a fast, cost-favorable, effective, and reliable way of predicting and validating wellbore performance.

SUMMARY

Embodiments of the disclosure pertain to a method of using a tracer additive (or sometimes just 'tracer') in a wellbore that may include one or more steps described herein.

The method may include forming a utility fluid mixture comprising the tracer additive. Another step may be disposing the utility fluid into the wellbore. This may occur or be accomplished at a sufficient flow rate and pressure so that the utility fluid comes into contact with a target formation. The target formation may be in (fluid) communication with the wellbore. The disposing step may occur from the same wellbore, or another wellbore.

Upon contacting the utility fluid with the target formation for an amount of time, the method may include returning a remnant fluid to a surface or surface facility. The produced remnant fluid may include a portion of the utility fluid (or some of its initial constituents, such as the first tracer). The produced remnant fluid may come from the same wellbore as the disposing step wellbore.

The method may include taking a sample of the remnant fluid. In that event, the method may include testing the sample in order to analyze the remnant fluid. At this point this may result in obtaining or otherwise providing a set of fluid data associated therewith. The method may include integrating the set of fluid data with other wellbore data in order to determine a parameter associated with performance of the wellbore.

In aspects, the tracer additive may have a first tracer composition. In other aspects, the tracer additive may be in a solid powder form. The powder may have an average particle diameter of at least 0.1 μm to no more than 10 μm. In aspects, the average particle diameter may be at least 0.1 μm to less than 1 μm.

The tracer additive may have been an average bulk specific gravity of at least 0.6 to no more than 1.2.

The wellbore or target formation may have various parameters associated with it. For example, the wellbore or target formation may be associated with a formation temperature of at least 1000° F. to no more than 2000° F. In other aspects, the wellbore or target formation may have an average permeability of 0.1 nanodarcy to 1000 nanodarcy.

The target formation may be part of a geothermal well, EOR process, or horizontal drilled well associated with hydraulic fracturing. In aspects, the remnant fluid may be used in an energy generation process. For example, a fluid may be injected into the geothermal well, energy (such as heat) added thereto, and then the fluid is produced to the surface, where the added energy may be converted in the energy generation process.

In some embodiments, the method may include disposing a second tracer additive into the wellbore. This may be done in a manner so that the second tracer additive comes into contact with one or more of the target formation, another target formation proximate to the wellbore, or combinations thereof.

The second tracer additive may have a different composition from the chemical additive (or first tracer additive). The second tracer may be in powder form. The second tracer additive may have an average particle diameter of at least 0.1 μm to no more than 10 μm (or any range inbetween). The second tracer additive may have an average bulk specific gravity of at least 0.6 to no more than 1.2. Although not limited, the second tracer may be disposed into and produced from the same wellbore.

The target formation may be associated with a frac stage. The wellbore or target formation may be associated with a formation temperature of at least 450° F. The formation temperature may be no more than 2000° F.

In aspects, the testing the sample step comprises using a fluorescence response-based analysis. The fluorescence response-based analysis may include EDXRF. The fluorescence response-based analysis may include XRD.

The parameter may be associated with flow mapping of the wellbore.

In aspects, the first tracer additive, the second tracer additive, and/or other tracer additives may be completely non-magnetic (that is, one of ordinary skill in the art would recognize the tracer has having a physical property of being non-magnetic). Any method of the disclosure may be completely void of a magnet(s) or any type of magnetic feature.

The remnant fluid may be filtered prior to testing or analysis. For example, the method may include a filtering step, which may include membrane filtration.

These and other embodiments, features and advantages will be apparent in the following detailed description and drawings.

BRIEF DESCRIPTION OF THE DRAWINGS

A full understanding of embodiments disclosed herein is obtained from the detailed description of the disclosure presented herein below, and the accompanying drawings, which are given by way of illustration only and are not intended to be limitative of the present embodiments, and wherein.

DETAILED DESCRIPTION

Figure 1:
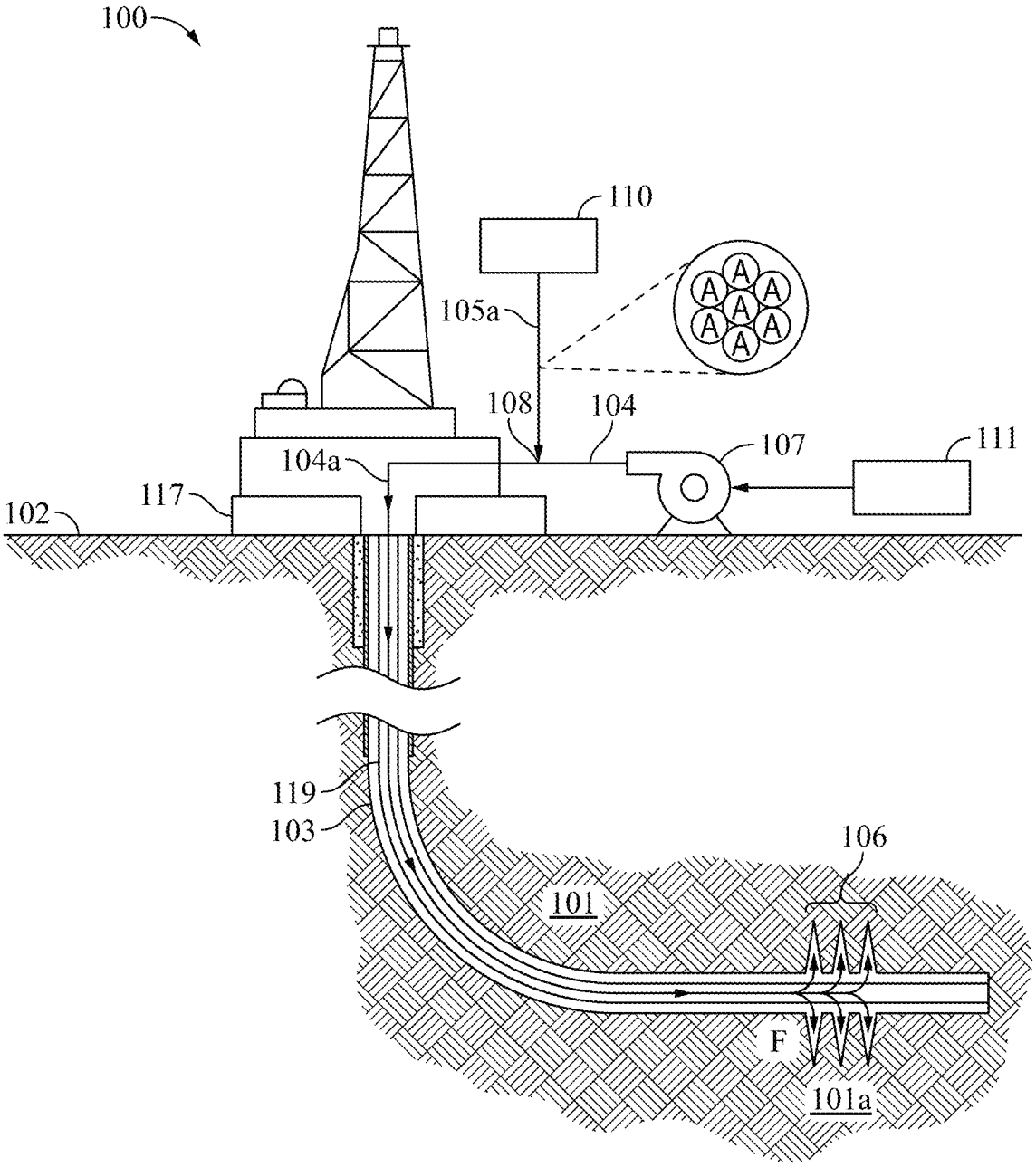
FIG. 1 shows a side view of a system for using a tracer additive in a wellbore according to embodiments of the disclosure.

Regardless of whether presently claimed herein or in another application related to or from this application, herein disclosed are novel apparatuses, units, systems, and methods that pertain to use of solid tracer additives, details of which are described herein.

Embodiments of the present disclosure are described in detail with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," etc., are used for convenience and to refer to general direction and/or orientation, and are only intended for illustrative purposes only, and not to limit the disclosure.

Connection(s), couplings, or other forms of contact between parts, components, and so forth may include conventional items, such as lubricant, additional sealing materials, such as a gasket between flanges, PTFE between threads, and the like. The make and manufacture of any particular component, subcomponent, etc., may be as would be apparent to one of skill in the art, such as molding, forming, press extrusion, machining, or additive manufacturing. Embodiments of the disclosure provide for one or more components to be new, used, and/or retrofitted to existing machines and systems.

Various equipment may be in fluid communication directly or indirectly with other equipment. Fluid communication may occur via one or more transfer lines and respective connectors, couplings, valving, piping, and so forth. Fluid movers, such as pumps, may be utilized as would be apparent to one of skill in the art.

Numerical ranges in this disclosure may be approximate, and thus may include values outside of the range unless otherwise indicated. Numerical ranges include all values from and including the expressed lower and the upper values, in increments of smaller units. As an example, if a compositional, physical or other property, such as, for example, molecular weight, viscosity, melt index, etc., is from 100 to 1,000. it is intended that all individual values, such as 100, 101, 102, etc., and sub ranges, such as 100 to 144, 155 to 170, 197 to 200, etc., are expressly enumerated. It is intended that decimals or fractions thereof be included. For ranges containing values which are less than one or containing fractional numbers greater than one (e.g., 1.1, 1.5, etc.), smaller units may be considered to be 0.0001, 0.001, 0.01, 0.1, etc. as appropriate. These are only examples of what is specifically intended, and all possible combinations of numerical values between the lowest value and the highest value enumerated, are to be considered to be expressly stated in this disclosure. Numerical ranges are provided within this disclosure for, among other things, the relative amount of reactants, surfactants, catalysts, etc. by itself or in a mixture or mass, and various temperature and other process parameters.

Terms

The term "connected" as used herein may refer to a connection between a respective component (or subcomponent) and another component (or another subcomponent), which can be fixed, movable, direct, indirect, and analogous to engaged, coupled, disposed, etc., and can be by screw, nut/bolt, weld, and so forth. Any use of any form of the terms "connect", "engage", "couple", "attach", "mount", etc. or any other term describing an interaction between elements is not meant to limit the interaction to direct interaction between the elements and may also include indirect interaction between the elements described.

The term "fluid" as used herein may refer to a liquid, gas, slurry, single phase, multi-phase, pure, impure, etc. and is not limited to any particular type of fluid such as hydrocarbons.

The term "utility fluid" as used herein may refer to a fluid used in connection with any fluid disposed into a wellbore (akin to an injection fluid). The utility fluid may be pressurized, and may be used to carry an additive into the wellbore. 'Utility fluid' may also be referred to and interchangeable with 'service fluid' or comparable.

The term "fluid connection", "fluid communication," "fluidly communicable," and the like, as used herein may refer to two or more components, systems, etc. being coupled whereby fluid from one may flow or otherwise be transferrable to the other. The coupling may be direct, indirect, selective, alternative, and so forth. For example, valves, flow meters, pumps, mixing tanks, holding tanks, tubulars, separation systems, and the like may be disposed between two or more components that are in fluid communication.

The term "pipe", "conduit", "line", "tubular", or the like as used herein may refer to any fluid transmission means, and may be tubular in nature.

The term "tubestring" or the like (such as 'workstring') as used herein may refer to a tubular (or other shape) that may be run into a wellbore. The tubestring may be casing, a liner, production tubing, combinations, and so forth. The tubestring may be multiple pipes (and the like) coupled together. The tubestring may be used for transfer of fluids, or used with some other kind of action, such as drilling, running a tool, or any other kind of downhole action, and combinations thereof.

The term "composition" or "composition of matter" as used herein may refer to one or more ingredients, components, constituents, etc. that make up a material (or material of construction). Composition may refer to a flow stream of one or more chemical components.

The term "chemical" as used herein may analogously mean or be interchangeable to material, chemical material, ingredient, component, chemical component, element, substance, compound, chemical compound, molecule(s), constituent, and so forth and vice versa. Any 'chemical' discussed in the present disclosure need not refer to a 100% pure chemical. For example, although 'water' may be thought of as H2O, one of skill would appreciate various ions, salts, minerals, impurities, and other substances (including at the ppb level) may be present in 'water'. A chemical may include all isomeric forms and vice versa (for example, "hexane", includes all isomers of hexane individually or collectively).

The term "water" as used herein may refer to a pure, substantially pure, and impure water-based stream, and may include wastewater, process water, fresh water, seawater, produced water, slop water, treated variations thereof, mixes thereof, etc., and may further include impurities, dissolved solids, ions, salts, minerals, and so forth. Water for a frac fluid can also be referred to as 'frac water'.

The term "impurity" as used herein may refer to an undesired component, contaminant, etc. of a composition. For example, a mineral or an organic compound may be an impurity of a water stream.

The term "frac fluid" as used herein may refer to a fluid injected into a well as part of a frac operation. Frac fluid is often characterized as being largely water, but with other constituents such as proppant, friction reducers, and other additives or compounds.

The term "produced fluid", "production fluid", and the like as used herein may refer to water, gas, mixtures, and the like recovered from a subterranean formation or other area near the wellbore. Produced fluid may include hydrocarbons or aqueous, such as flowback water, brine, salt water, or formation water. Produced water may include water having dissolved and/or free organic materials. Produced fluid may be akin to 'wellbore fluid', in that the fluid may be returned from the wellbore. Produced fluid may include utility fluids and formation fluids.

The term "frac operation" as used herein may refer to fractionation of a downhole well that has already been drilled. 'Frac operation' can also be referred to and interchangeable with the terms fractionation, hydraulic fracturing, well stimulation, production enhancement, hydrofracturing, hydrofracking, fracking, fracing, and frac. A frac operation can be land or water based. Generally, the term 'fracing' or 'frac' is used herein, but meant to be inclusive to other related terms of industry art.

The phrase "processing a fluid" as used herein may refer to some kind of active step or action, such as man-made or by machine, imparted on the fluid (or fluids). For example, a fluid may be received into a device (such as a mixer) and upon processing, may leave as a 'processed fluid'. 'Processed' is not meant be limited, as this may include reference to transferred, treated, tested, measured, mixed, sensed, separated, combinations, etc. in whatever manner may be desired or applicable for embodiments herein. It is noted that while various steps or operations of any embodiment herein may be described in a sequential manner, such steps or operations may be operated in batch or continuous fashion.

The term "conventional well" as used herein may refer to a subterranean formation having an average permeability in the magnitude range of a millidarcy or higher.

The term "unconventional well" as used herein may refer to a subterranean formation having an average permeability in the magnitude range of a nanodarcy or smaller.

The term "tracer" as used herein may refer to an identifiable substance, such as a liquid dye, liquid chemical or a particles powder, which may be followed through the course of a mechanical, chemical, or biological process. In the present disclosure, a tracer may be used in a well, and the resultant process impact on the tracer evaluated. In this respect, the tracer may help evaluate, determine, and otherwise model well production and performance. The tracer may be added (and thus may be referred to as a 'tracer additive' or 'additive') to a utility (or service, injection, etc.) fluid disposed into the well.

The term "nanoparticle" as used herein may refer to a small particle that ranges between 1 to 1000 nanometers in size diameter, and is undetectable by the human eye. A tracer in powder form may be nanoparticles. A tracer additive of the present disclosure may be in powder form with an average bulk diameter in a range of about 0.1 μm to about 10 μm (or any range therebetween).

The term "EDXRF" (Non-destructive Energy Dispersive X-Ray Fluorescence) as used herein may refer to a type of spectroscopy process (and may thus include use of a spectrometer) where a sample of material (such as a portion of produced fluid) is 'excited' in order to collect emitted fluorescence radiation, which may then be evaluated for different energies of the characteristic radiation from each of the different constituents (or elements) in the sample. The EDXRF process may be referred to as a fluorescence response-based analytical process.

EDXRF may be considered a non-destructive analytical technique used to determine the elemental composition of materials. EDXRF analyzers determine the elemental composition of a sample by measuring the fluorescent (or secondary detectable energy) X-ray emitted from a sample when it is excited by a primary X-ray source. EDXRF is designed to analyze groups of elements simultaneously to determine those elements presence in the sample and their relative concentrations—in other words, the elemental composition of the sample. Each of the elements present in a sample produces a unique set of characteristic X-rays that is a "fingerprint" for that specific element. X-rays have a very short wavelength, which corresponds to very high energy. All atoms have several electron orbitals (K shell, L shell, M shell, for example). When X-ray energy causes electrons to transfer in and out of these shell levels, X-ray fluorescence peaks with varying intensities are created and will be present in the spectrum. The peak energy identifies the element, and the peak height or intensity is indicative of its concentration.

The term "XRD" may refer to X-ray diffraction, which is a technique for analyzing the atomic or molecular structure of materials. It is non-destructive, and works most effectively with materials that are wholly, or part, crystalline. The technique is often known as x-ray powder diffraction because the material being analyzed typically is a finely ground down to a uniform state. Diffraction is when light bends slightly as it passes around the edge of an object or encounters an obstacle or aperture. The degree to which it occurs depends on the relative size of a wavelength compared to the dimensions of the obstacle or aperture it encounters.

All diffraction methods start with the emission of x-rays from a cathode tube or rotating target, which is then focused at a sample. By collecting the diffracted x-rays, the sample's structure can be analyzed. This is possible because each mineral has a unique set of d-spacings. D-spacings are the distances between planes of atoms, which cause diffraction peaks.

The term "flow mapping" as used herein may refer to the process of analyzing and measuring the movement of fluids within and between various wells and from each frac stage and the surrounding reservoir. A resultant flow mapping parameter may help in understanding the flow patterns of hydrocarbons and water, often essential for optimizing production, refining the well and frac designs, and improving recovery techniques. Interpreting the flow patterns based on solid tracers can identify issues such as reservoir heterogeneity, fluid movement behavior, and potential flow blockages. Flow mapping may help in making informed decisions about drilling, production strategies, and enhanced recovery methods. Monitoring of flow data over time using solid tracers can detect changes in well and stage-specific flow performance, which can then drive future re-frac schedules or intervention strategies. Overall, flow mapping is a crucial tool in optimizing oil and gas extraction processes and maximizing resource recovery.

The term "non-magnetic" as used herein may refer to physical property understood by one of ordinary skill in the art as not having any magnetic behavior or properties. Therefore, embodiments of the disclosure may be completely void of using magnets or anything having magnetic features.

Referring now to FIG. 1, FIG. 2, FIG. 3, FIG. 4, and FIG. 5 together, a side view of a system (and related method) for using a tracer additive in a wellbore; a side view of the system of FIG. 1 where a remnant fluid with the tracer additive is produced from the wellbore; a simplified block diagram of an analytical testing unit used to test a sample having a tracer additive; a side view of the system of FIG. 1 for using a second tracer additive in a wellbore; and a side view of a system for using a tracer additive in a formation having multiple wellbores, respectively, according to embodiments disclosed herein, are shown.

System 100 may include one or more components (or subcomponents) coupled with new, existing, or retrofitted equipment. System 100 may include one or more units that are skid mounted or may be a collection of skid units, and the system 100 may be suitable for onshore and offshore environments.

The system 100 may have various valves, flanges, pipes, pumps, utilities, monitors, sensors, controllers, flow meters, safety devices, etc., for accommodating sufficient universal coupling between system components and any applicable feedline/feed source of a material to be processed, any resultant product material to be discharged or transferred therefrom, and anything in between.

FIG. 1 is meant to show in a simplistic manner embodiments herein, and may not be to scale. The system 100 may include a subterranean or earthen formation 101 having a wellbore 103 drilled or otherwise formed therein. The formation 101 may be a type of conventional or unconventional reservoir. The formation 101 may contain hydrocarbonaceous fluids, such as oil, natural gas, and/or other materials, generally designated as F. The formation 101 may include porous and permeable rock containing liquid and/or gaseous hydrocarbons. The formation may include a conventional reservoir, an unconventional reservoir, a tight gas reservoir, and/or other types of reservoirs. Moreover, the illustration of a mover (pump) 107 is not meant to infer other equipment is not present, of which one of ordinary skill in the art is well versed.

The system 100 may include one or more additional wellbores, production wells, etc. The example wellbore 103 shown in FIG. 1 illustrates the wellbore 103 may have at least a partial horizontal trajectory. However, any wellbore of the system 100 may include any combination of horizontal, vertical, slant, curved, directional-drilled, and/or other well geometries.

The wellbore 103 may be open, closed, cased, uncased, etc. Although not shown in detail here, the wellbore 103 may have a tubestring 119 disposed therein, such as for deploying tools or fluids into the wellbore 103. In other aspects, the tubestring 119 may be a production tubing, whereby formation and wellbore fluids may be readily transported to a surface or surface facility 102.

The formation 101 may include a target formation 101*a*, which may be believed to be a hydrocarbon-rich area of the formation 101. The target formation 101*a* may be a stage or zone, which may be part of or associated with a fracing operation. Just the same, the target formation 101*a* may just be part of the formation 101 without the need for enhanced oil recovery (EOR) or other type of treatment.

In the event of EOR, and although not limited to any particular type of EOR/IOR or comparable operation, in multistage fracturing, the wellbore 103 may require the stimulation and production of one or more zones of a formation. Conventionally, a liner, casing, or other type of tubestring 119 may be used downhole, in which the tubestring 119 includes one or more downhole frac valves (any may further include, but not be limited to, ported sleeves or collars) at spaced intervals along the wellbore. Just the same, the target formation 101*a* may be fractured with a plug-and-perf operation.

It may be the case that the target formation 101*a* has perforations 106. The perforations may result from a fracing operation or may naturally exist. The perforations 106 shown here are exaggerated in scale for case of understanding to the reader, but may in reality be small in scale.

In the event of tight formation characteristics, such as in the case of an unconventional reservoir, the target formation 101*a* may have an average permeability of about 0.1 nanodarcy to about 1000 nanodarcy. By way of comparison, the target formation 101*a* may be disposed in a conventional reservoir, and thus may have an average permeability in a range of about 0.1 millidarcy to about 1 darcy (or more).

The formation 101 might have other geologic characteristics, including hot formation temperatures. For example, the target formation 101*a* may have an average formation temperature T of about 450° F. In embodiments, the average formation temperature T may be in a range of about 100° F. to about 800° F. The formation temperature T may have a relationship to the depth, geological environment, and tightness of the formation 101.

Diagnostic information about the performance of the wellbore 103 may be determined by utilizing a first tracer additive 105*a*. The first tracer additive 105*a* (or other tracer additives described herein) may be of a suitable material for use with any type of formation 101. Just the same, the first tracer additive 105*a* may have a (predetermined) first composition A, which results in characteristics (or traits) suitable for use in the event the formation 101 has conditions normally undesirable for the use of tracers, namely, liquid tracers.

As a first characteristic, the first tracer 105*a* may be a solid tracer in the form of a powder. The use of powder form makes the first tracer 105*a* attractive for use in high temperature conditions. The first tracer 105*a* may comprise powder nanoparticles. In embodiments, the particles of the first tracer 105*a* may have an average particle diameter of about 0.1 μm to about 10 μm. The first tracer 105*a* may have a first tracer specific gravity. In embodiments, the first tracer 105*a* may have an average bulk specific gravity of about 0.6 to about 1.2. The first tracer 105*a* may have a physical property of being non-magnetic, and thus non-responsive to any kind of magnet device. The first tracer 105*a* may be inert.

The first tracer 105*a* may be transferred (e.g., a blower, pump, gravity feed, etc.) from a tracer feed source 110 (such as a hopper or the like), and mixed with a carrier fluid 104. The carrier fluid 104 may be or include water. Other materials may be mixed with the carrier fluid, such as sand, proppant, etc. The carrier fluid 104 may be transferred toward mixer or mixing point 108 from a carrier fluid source 111. For example, a pump 107 may be used to pump the carrier fluid 104 from the source 111 toward a wellhead (injection point) 117, and through the tubestring 119.

The mixer 108 may be any device suitable to form an injection or utility fluid mixture 104*a*. The first tracer 105*a* may be completely miscible with the carrier fluid 104. The first tracer 105*a* may be inert in the respect that there is no effect by the first tracer 105*a* on the carrier fluid 104 and/or the formation 101 (or target formation 101*a*) and/or vice versa.

Suitable equipment such as the pump 107 may be used for the transfer and disposing of the utility mixture 104*a* into the wellbore 103. As may be seen, the utility mixture 104*a* may be disposed into the same wellbore 103 from which the tracer 105*a* may be later produced. Sufficient pressure and flowrate may be selected and used in order to adequately provide the utility mixture 104*a* to the target formation 101*a*. The first tracer 105*a* may exit the tubestring 119, and eventually come into contact with the target formation 101*a* and/or the perforations 106. The tracer 105*a* may be provided to the target formation 101*a* through standard flow configurations, such as ports/sleeves within the tubestring 119, or out of a toe, and vice versa for production to the surface 102.

The tracer 105*a* (or at least a portion thereof) may have an average residence time in the target formation 101*a* and/or the perforations 106. In the event the system 100 uses a fracing operation for a stage or a zone, the first tracer additive 105*a* may be selected for its particular uniqueness, and thus preferably has a different tracer characteristic (fingerprint) from other tracer additives used in the fracing operation so that fluid returned from each particular stage may be identified. The tracer characteristic may be the chemical identity of the tracer additive used, such as composition or specific gravity. The tracer characteristic may be distinguishable from the tracer characteristic(s) of any other tracer additives used.

Figure 3:
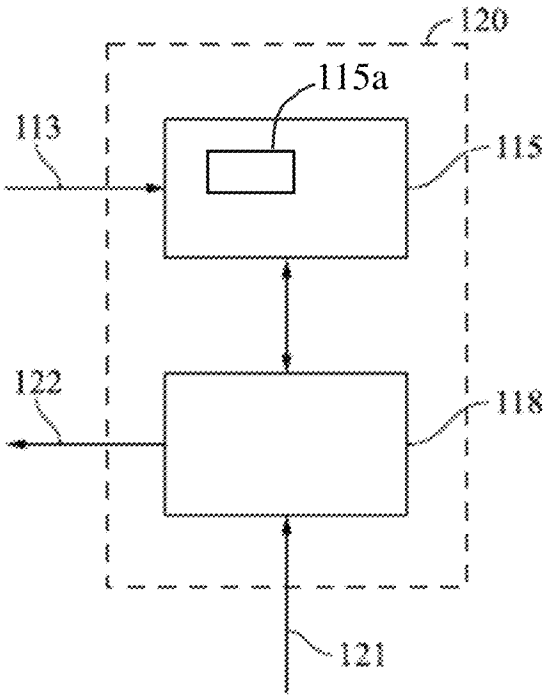
FIG. 3 is a simplified block diagram of an analytical unit used to test a sample having a tracer additive according to embodiments of the disclosure.
Figure 2:
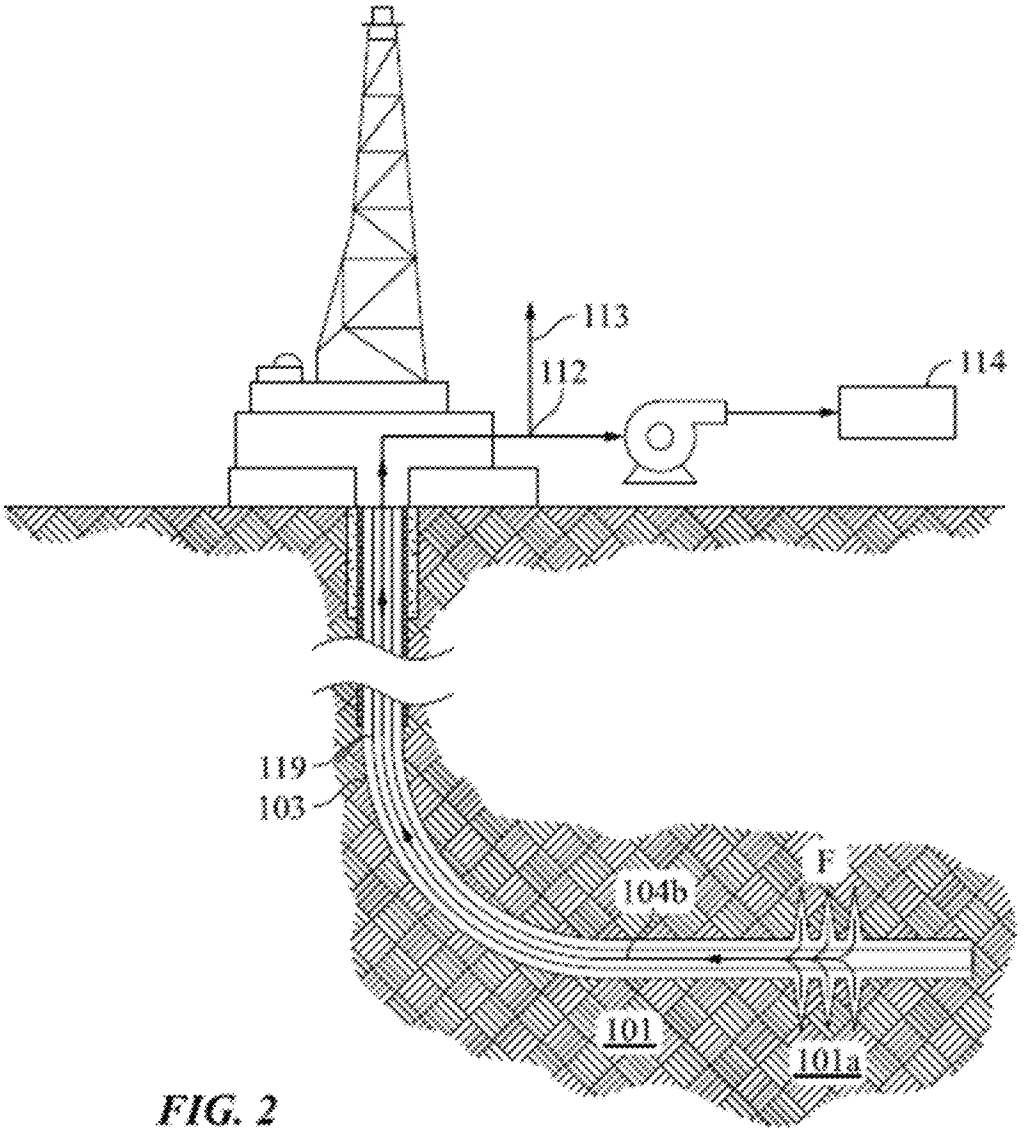
FIG. 2 is a side view of the system of FIG. 1 where a remnant fluid with the tracer additive is produced from the wellbore according to embodiments of the disclosure.

FIGS. 2 and 3 illustrate whereby the first tracer 105*a* may be brought back to the surface 102 (although not limited, this may be from the same wellbore 103 it was introduced) for testing. For example, after the predetermined time period, a remnant fluid 104*b* may be produced. The remnant fluid 104*b* may include, at least partially, (some of) the first tracer 105*a*, the carrier fluid, and formation fluids F. A sample of the remnant fluid 104*b* may be produced on a desired frequency, such as daily. The sampling can occur during the desired frequency over a predetermined timeframe, which may be days or months (e.g., 6 months).

Once the remnant fluid 104*b* is produced from the wellbore 103, a sample 113 may be taken or extracted from sample point 112. The rest of the remnant fluid 104*b* may be transferred to a desired destination 114, which may be a tank, a pond, another well, or other suitable storage.

The sample 113 may now be tested via test unit 120. Prior to or as part of testing, the sample 113 may be filtered, resulting in a filtered sample 113. Filtration may occur, for example, by membrane filtration. Filtration may occur at or with test unit 120.

The test unit 120 may include analysis equipment 115, which may be in operable communication with computing system 118. The test unit 120 (and/or analysis equipment) may include filtration equipment 115*a*. The computing system 118 may be configured for use in using analytical data associated with use of the test equipment 115. The test equipment 115 may provide a fluorescence response-based process, such as EDXRF and XRD.

The computing system 118 may be useful to further analyze data and other information in order to provide an indication related to performance of the wellbore 103. This may pertain to, for example, the time the tracer additive was detected, the location where the tracer additive was use, the type and composition of the tracer additive detected, the amount or concentration of tracer additive detected, and/or other measurements provided by the equipment 115 and the system 118.

The computing system 118 may have Artificial intelligence (A.I.) based diagnostics. The computing system 118 may access input data 121, which may be related to other aspects of the formation 101, such as geological information, fractures, and the like. The computing system 118 may include programs, scripts, and/or other types of computer instructions that generate output data 122, which may be based on the input data 121. The output data 122 may include descriptions of fluid flow patterns in the formation 101, which may identify paths of fluid flow in the wellbore 101, wellbore breaches or cross-communication (such as to a proximate offset well), fracture locations, fluid flow rates, and/or other information. For example, the output data 122 may be used for flow mapping the wellbore 103.

Figure 4:
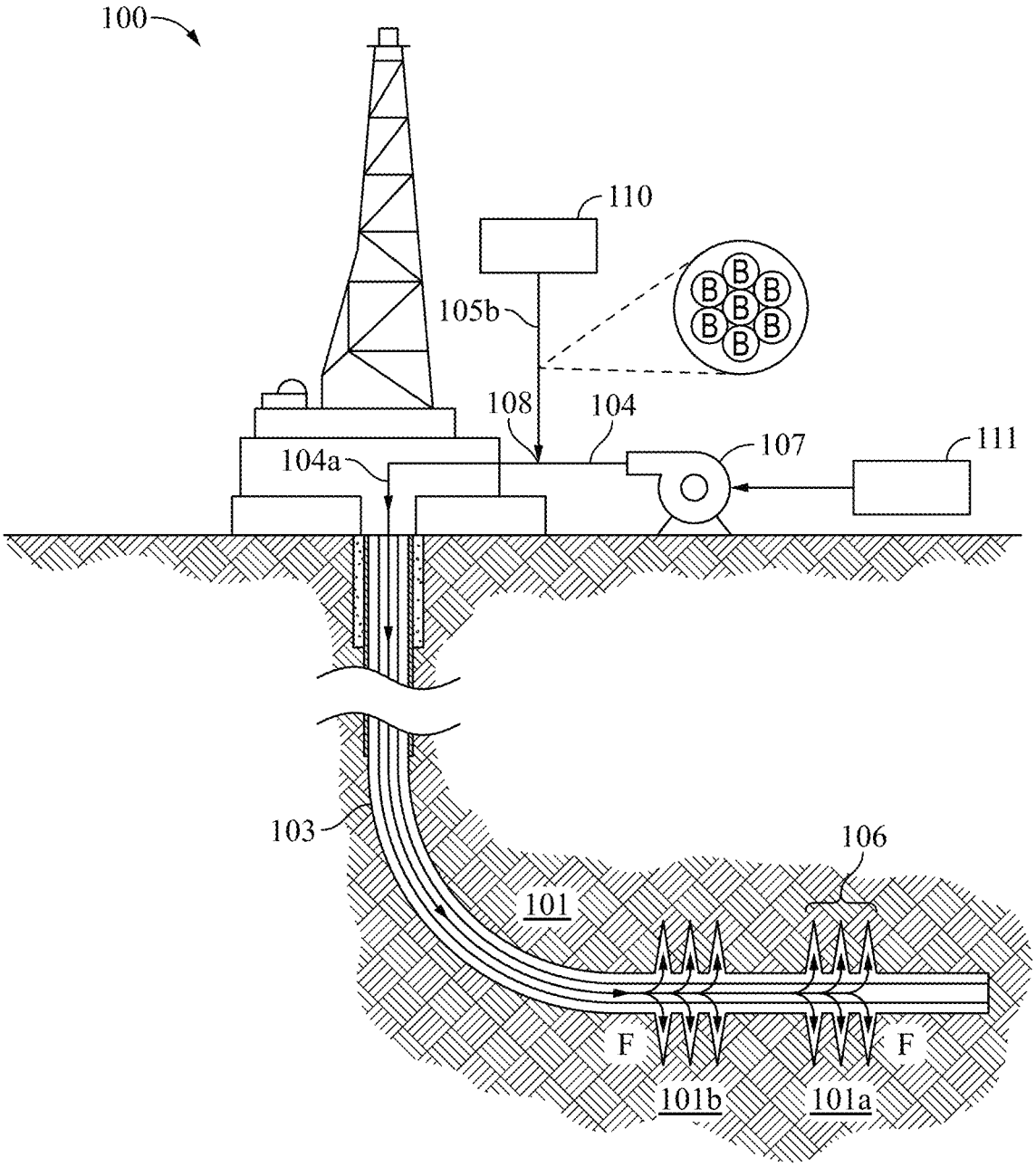
FIG. 4 is a side view of the system of FIG. 1 for using a second tracer additive in a wellbore according to embodiments of the disclosure.

FIG. 4 illustrates an analogous manner of disposing a second tracer additive 105*b* into the wellbore 103. The second tracer additive 105*b* may be like that of the first tracer additive 105*b*, and thus have similar composition and characteristics; however, the second tracer additive may have a second composition B different from that of the first composition A. The use of a different composition B provides a unique identifier and fingerprint as compared to that of the composition A.

The second composition B may be different from the first composition A, yet the second tracer 105*b* may have characteristics similar to that of the first tracer 105*a*. For example, the second tracer 105*b* may be an inert solid (in powder form) having a respective average particle diameter of about 0.1 μm to about 10 μm. The second tracer 105*b* may have a respective average bulk specific gravity of about 0.6 to about 1.2.

The second tracer 105*b* may be transferred from the tracer feed source 110, and mixed with the carrier fluid 104 at mixer or mixing point 108 to form the utility mixture 104*a*. The utility mixture in this instance may thus include the carrier fluid 104 and the second tracer 105*b*. Sufficient pressure and flowrate may be selected and used in order to adequately provide the utility mixture 104*a* to a new or second target formation 101*b*. The second target formation 101*b* may be associated with a stage or zone of a frac operation. Just the same the second target formation 101*b* may just be part of the formation 101. The second target formation 101*b* may have its own respective perforations 106.

As before with the first tracer 105*a*, after the predetermined time period, a remnant fluid 104*b* may be produced. The remnant fluid 104*b* may include, at least partially, (some of) the first tracer 105*a*, the second tracer 105*b*, the carrier fluid, and formation fluids F.

Once the remnant fluid 104*b* is produced from the wellbore 103, a sample 113 may be taken or extracted from sample point 112.

The system 100 may be modified or adjusted based on the detection of tracers released from the formation 101. For example, well system tools, and/or other subsystems may be installed, adjusted, activated, terminated, or otherwise modified based on the information provided by the tracers. Additional fractures can be formed in the formation 101, and/or other modifications can be made based on information provided by the tracers. In some embodiments, modifications of the system 100 may be selected and/or parameterized to improve production from the formation 101. For example, the modifications may improve the sweep efficiency. Modifications of well system 100 may be selected and/or parameterized by the computing system based on data analysis performed by the computing system.

Figure 5:
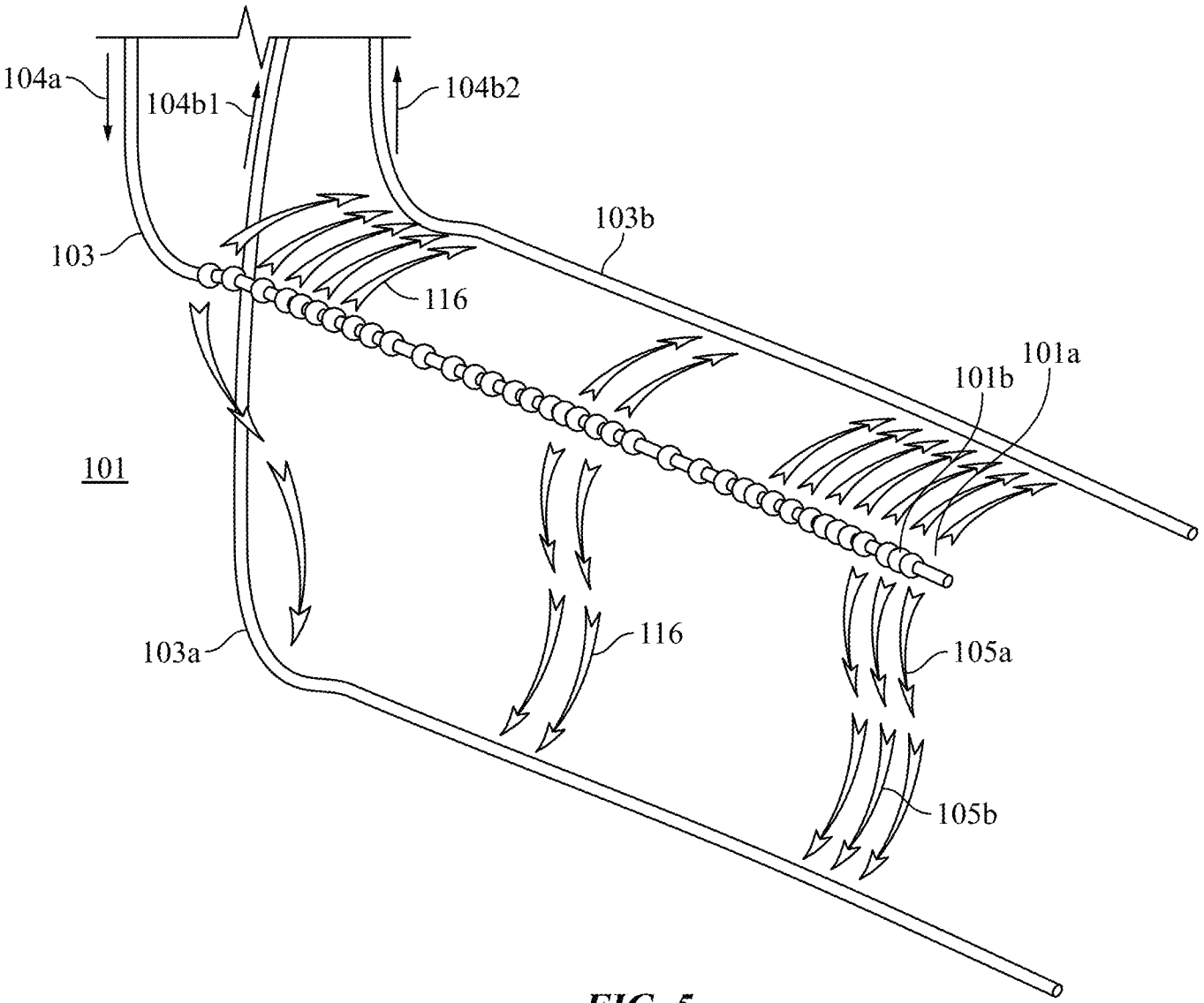
FIG. 5 is a side view of a system for using a tracer additive in a formation having multiple wellbores according to embodiments of the disclosure.

Briefly, FIG. 5 illustrates an embodiment where a utility fluid 104*a* may disposed into a wellbore 103 in a suitable manner to provide a first tracer additive 105*a* to a first target formation 101*a*, and subsequently a second tracer additive 105*b* to a second target formation 101*b*. Other tracers may be added for other areas of the formation 101. The tracer additives 105*a*, 105*b* may be like that as described herein.

As shown here, there may be a plurality of wellbores, such as first offset wellbore 103*a* and second offset wellbore 103*b*. In some embodiments, it may be desirous to establish far-field analysis or otherwise detect cross-communication 116 or breakthrough between the wellbores 103, 103*a*, 103*b*. As shown here, the first tracer additive 105*a* may pass from the wellbore 103 into any of the offset wellbores via flowpath 116. Similarly, the second tracer additive 105*b* may pass from the wellbore 103 to any of the offset wellbores via flowpath 116. Other tracer additives may be used and passed, as well.

Remnant fluids 104*b*1, 104*b*2 may be produced from the respective wellbores and have samples taken and tested in accordance with embodiments herein.

Figure 6B:
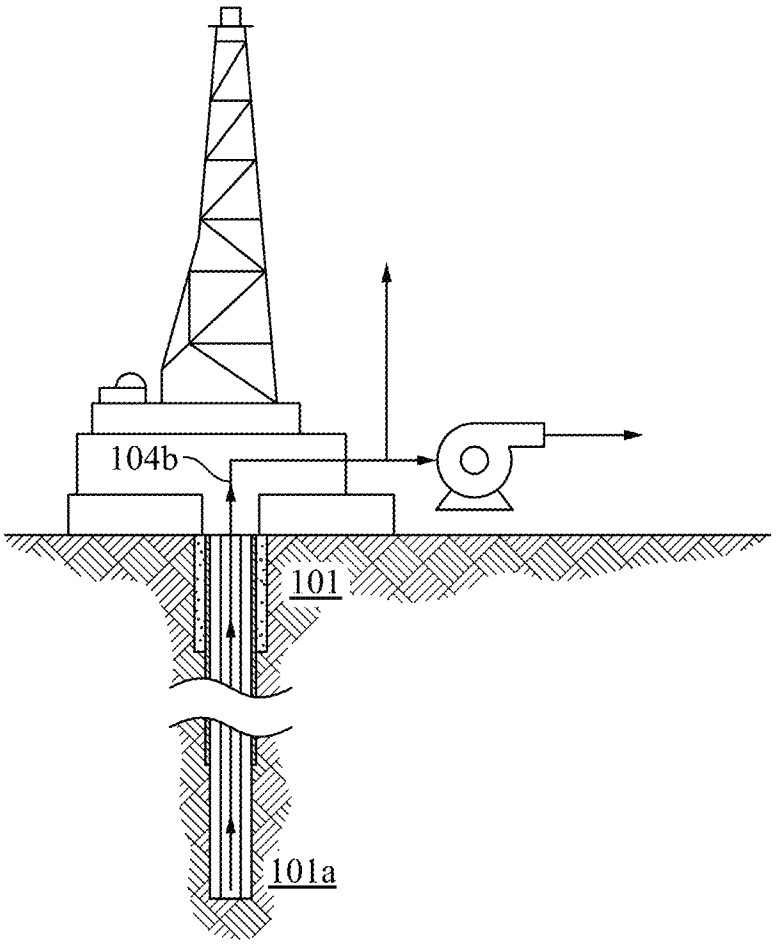
FIG. 6B shows a side view of the system of FIG. 6A where a remnant fluid with the tracer additive is produced from the wellbore according to embodiments of the disclosure.
Figure 6A:
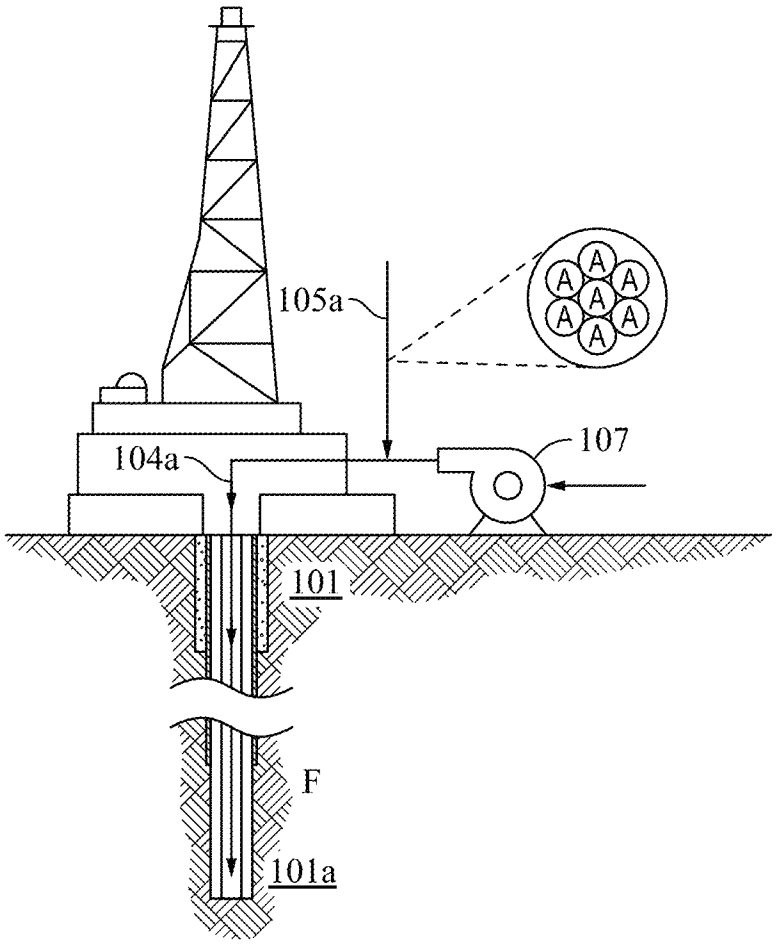
FIG. 6A shows a side view of a system for using a tracer additive in a geothermal well according to embodiments of the disclosure.
Figure 6C:
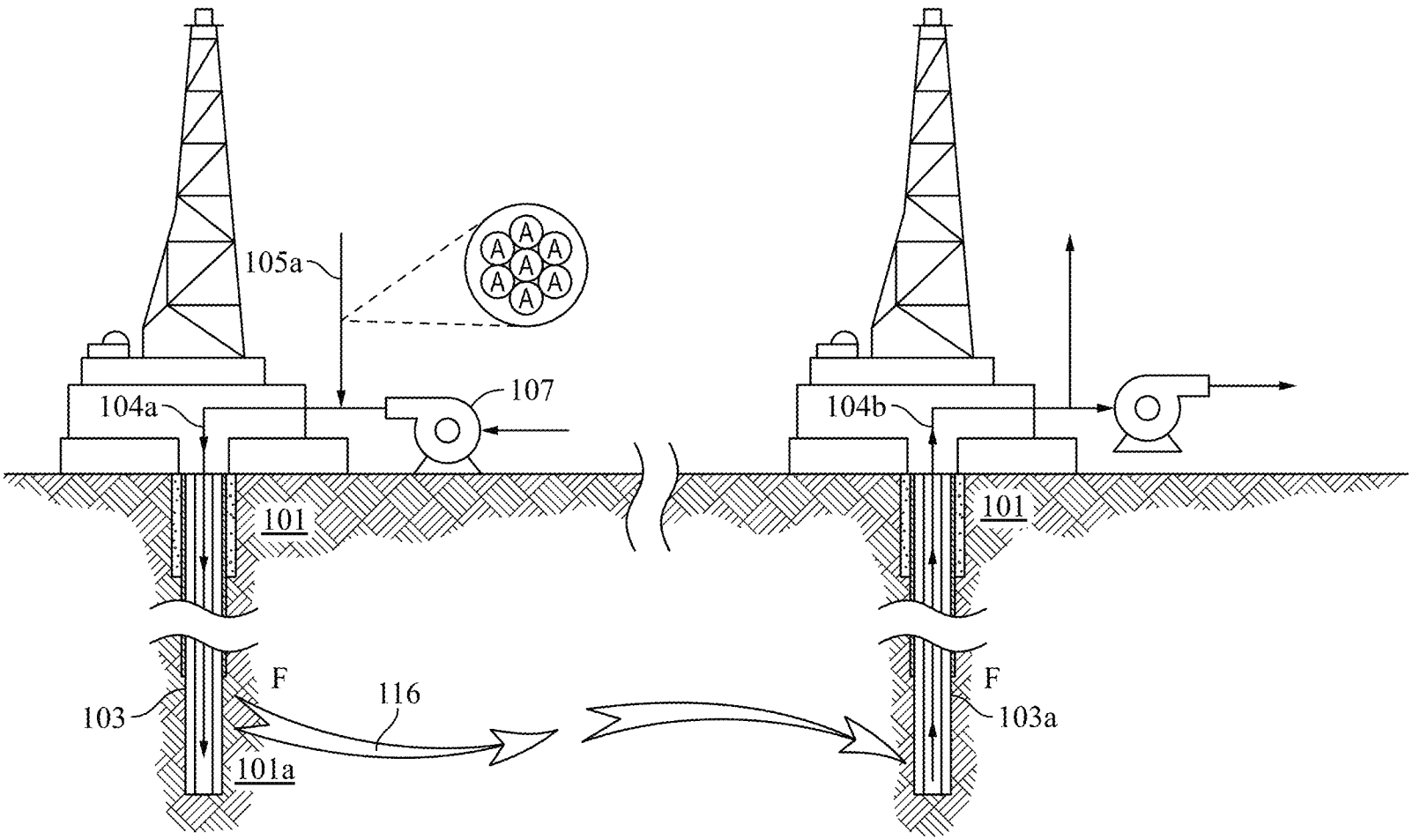
FIG. 6C shows a side view of the system of FIG. 6A where a remnant fluid with the tracer additive is produced from a proximate wellbore according to embodiments of the disclosure.

Briefly, FIG. 6C illustrates a side view of a system for using a tracer additive in a geothermal well, and a side view where a remnant fluid with the tracer additive is produced from another nearby well. For example, cross-communication 116 may exist between the wellbore 103 and the nearby wellbore 103*a*. As such, the remnant fluid 104*b* may be produced from the nearby wellbore 103*a*.

Example

Embodiments herein provide for a method of subsurface flow mapping using ultrahigh resolution nanoparticle tracer technology. Methods of the disclosure may provide for a tracer portfolio that integrates advanced computational methods using Artificial Intelligence (A.I.). Such use may provide accurate, actionable, near real-time performance-flow-profile data. This may allow oil and gas operators to: optimize completion strategies; achieve the best production per foot; reduce completion and fracturing cost; and/or reduce environmental footprint.

Tracer technology described herein may be based on proprietary inert, non-magnetic submicron particles and other environmentally friendly and cost-effective additives that are used to manufacture the right composition of each tracer. This tracer technology may utilize special inert particles fingerprinting with certain atoms as special indicators that enhance the properties of each tracer. These may then detected at the sub-atomic structure level using robust capabilities of EDXRF-type spectroscopy measurements, and therefore ensuring superior accuracy for each tracer's detection and characterization from different subsurface environments.

The tracer additives may be injected at the parts per million (PPM) concentrations via mixer or blender equipment, and pumped (injected) downhole into well using high-pressure pumps for any given fracturing stage. The mixer equipment may be designed to integrate a slurry of water, sand, dry chemicals, and liquid chemicals to provide the desired fracing components and fluid rheology for any target formation.

After a completion process is completed and the well flown back, the deployed tracers are then recovered with production flowback or produced fluids from treatment or/and adjacent wells.

During the back flowing of the well, reservoir oil/gas samples are taken on a regular basis, such as for the first 10 to 40 days. The number of days may as desired, such as up to 180 days. A small amount of the sample is analyzed using appropriate methods to detect the presence and concentration of tracer compound. Samples from traced and/or offset wells may be collected on a predetermined basis (such as daily) from production flowback at the wellhead or other suitable sample point. The sample may then be tested via a fluorescence response-based process, such as EDXRF and XRD. Such analytical techniques may be used to determine the elemental composition and crystallinity of the samples.

EDXRF is designed to analyze groups of elements simultaneously to determine those elements presence in the sample and their relative concentrations—in other words, the elemental composition of the sample. Each of the elements present in a sample produces a unique set of characteristic X-rays that is a "fingerprint" for that specific element. X-rays have a very short wavelength, which corresponds to very high energy.

Due to sub-atomic accuracy of both detection methods, it is possible to precisely determine the elemental composition, crystallographic structure, and the various combinations of hyperfine interactions in the samples, which enables very accurate identification of the tracer additives on the sub-atomic or quantum level.

Laboratory analysis that may include or incorporate advanced computational methods and proprietary diagnostics capabilities for each stage or target formation provides accurate, calibrated, actionable and cost-effective production diagnostics results. This enables operators to reduce operational cost and increase the production in oil and gas wells.

Embodiments herein may produce and achieve an extensive and long-term dataset from tracer additives during production flow profile analysis at each target formation. This information may be used together with advanced computational methods using Artificial Intelligence (A.I.) coupled with artificial neural network may provide precise completion optimization workflows for oil and gas wells.

Embodiments herein pertain to a method(s) of using a tracer additive in a wellbore. The method may include one or more steps, which may vary in sequence and scope. The method may include forming a utility fluid mixture comprising the tracer additive. Forming may occur from inline mixing of the like. The utility fluid may then be disposed or otherwise transferred into the wellbore.

The utility fluid may be disposed at a sufficient flow rate and pressure so that the utility fluid comes into contact with a target formation in communication with the wellbore. A such, the flow rate and pressure may be adequate to transfer the utility fluid through a tubestring, into the wellbore, and then into contact with the target formation (such as through sleeve ports, a toe sleeve, or the like).

Upon contacting the utility fluid with the target formation for an amount of time (which may be predetermined or as otherwise desired), the method may include returning (producing, etc.) a remnant fluid to a surface. One of skill would appreciate the surface refers to above-ground production equipment, facilities, and so forth, being common in fracing operations.

The method may include taking a sample of the remnant fluid, and then testing the sample in order to analyze the remnant fluid in order to provide a set of fluid data. The method may include filtering the sample or remnant fluid to provide a filtered version of the same.

The method may include integrating (or otherwise analyzing, comparing, etc.) the set of fluid data with other wellbore data in order to determine a parameter associated with performance of the wellbore.

The method may utilize the tracer additive having a first tracer composition. The tracer additive may be in powder (i.e., solid) form having an average particle diameter of at least 0.1 μm to no more than 10 μm (or any range therebetween). The tracer additive may have an average bulk specific gravity. For example, the average bulk specific gravity may be in a range of at least 0.6 to no more than 1.2.

The wellbore may be associated with extreme conditions, such as formation temperature of at least 1000° F. to no more than 2000° F. The formation (or the target formation) may have an average permeability of 0.1 nanodarcy to 1000 nanodarcy. In aspects, the target formation may be part of a geothermal well. In this respect, the remnant fluid may be used in an energy generation process.

The method may include additional steps, such as disposing a second tracer additive into the wellbore. The disposing step may be done in such a manner that the second tracer additive may come into contact with one or more of the target formation, another target formation proximate to the wellbore, or combinations thereof.

The second tracer additive may have a different composition from the first chemical tracer, but otherwise may also be in powder form, may have an average particle diameter of at least 0.1 μm to no more than 10 μm, and may have average bulk specific gravity of at least 0.6 to no more than 1.2.

The target formation may be associated with a frac stage, wherein the wellbore is associated with a formation temperature of at least 450° F. to no more than 2000° F., and wherein the target formation has an average permeability of 0.1 nanodarcy to 1000 nanodarcy. The testing the sample step may include using a fluorescence response-based analysis. In aspects, the fluorescence response-based analysis comprises EDXRF. In aspects, the fluorescence response-based analysis comprises XDR.

Any tracer of the present disclosure may be entirely non-magnetic.

Any sample or remnant fluid of the present disclosure may be filtered prior to or as part of testing and analysis.

Advantages

Embodiments herein may provide for a new and improved method and system related to the use of chemical tracers in various settings associated with an earthen formation, such as an oil and gas well or a geothermal well.

The tracer may be cost-effective and inert, stable at (excessively) high temperatures, compatible with formation fluids, non-intrusive to completion design, easy to use, and quickly tested. Other advantages may include use of tracers that are of a cost-effective material, inert and lightweight, easily deployed, non-hazardous and non-radioactive, a single tracer for water and oil phases, and precise sub-atomic accuracy.

While preferred embodiments of the disclosure have been shown and described, modifications thereof may be made by one skilled in the art without departing from the spirit and teachings of the disclosure. The embodiments described herein are exemplary only and are not intended to be limiting. Many variations and modifications of the embodiments disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A method of using an inert, non-magnetic tracer additive in a wellbore, the method comprising:

forming a utility fluid mixture comprising the inert, non-magnetic tracer additive;

disposing the utility fluid into the wellbore at a sufficient flow rate and pressure so that the utility fluid comes into contact with a target formation in communication with the wellbore;

upon contacting the utility fluid with the target formation for an amount of time, returning a remnant fluid that includes at least a portion of the inert, non-magnetic tracer additive to a surface;

taking a sample of the remnant fluid;

providing the sample to a surface facility;

testing the sample at the surface facility via non-destructive energy dispersive x-ray fluorescence (EDXRF) in order to analyze the remnant fluid via energy excitation at a sub-atomic level in order to provide a set of fluid data associated with an elemental composition of the remnant fluid;

integrating the set of fluid data with other wellbore data in order to determine a parameter associated with performance of the wellbore, disposing a second non-magnetic tracer additive into the wellbore so that the second tracer additive comes into contact with one or more of the target formation, another target formation proximate to the wellbore, or combinations thereof, wherein the inert, non-magnetic tracer additive has a first tracer composition, wherein the inert, non-magnetic tracer additive is in a solid powder form having an average particle diameter of at least 0.1 μm to less than 1 μm, wherein the target formation is associated with a frac stage, wherein prior to testing the sample, the sample is filtered, wherein the wellbore is associated with a formation temperature of at least 450° F. to no more than 2000° F., wherein the target formation has an average permeability of at least 0.1 nanodarcy to no more than 1000 nanodarcy, wherein no step of the method uses or is associated with at least one of: a magnet, a magnetic feature, and combinations thereof, and wherein the second tracer additive is a different composition from the tracer additive, but is otherwise also in non-magnetic powder form, with an average particle diameter of at least 0.1 μm to less than 1 μm.

2. The method of using the inert, non-magnetic tracer additive of claim 1, wherein the parameter is associated with flow mapping of the wellbore.

3. The method of using the inert, non-magnetic tracer additive of claim 1, wherein the target formation is part of a geothermal well, and the remnant fluid is used in an energy generation process.

4. A method of using a tracer additive in a wellbore, the method comprising:

forming a utility fluid mixture comprising the tracer additive;

disposing the utility fluid into the wellbore at a sufficient flow rate and pressure so that the utility fluid comes into contact with a target formation in communication with the wellbore;

upon contacting the utility fluid with the target formation for an amount of time, returning a remnant fluid that includes at least a portion of the utility fluid to a surface;

taking a sample of the remnant fluid;

providing the sample to a surface facility;

testing the sample at the surface facility via non-destructive energy dispersive x-ray fluorescence (EDXRF) in order to analyze the remnant fluid via energy excitation at sub-atomic level in order to provide a set of fluid data associated with an elemental composition of the remnant fluid;

integrating the set of fluid data with other wellbore data in order to determine flow mapping performance of the wellbore;

disposing a second tracer additive into the wellbore so that the second tracer additive comes into contact with one or more of the target formation, another target formation proximate to the wellbore, or combinations thereof, wherein prior to testing the sample, the sample is filtered, wherein the tracer additive has a first tracer composition, wherein the tracer additive is in a non-magnetic solid powder form having an average particle diameter of at least 0.1 μm to less than 1 μm, wherein no step of the method uses or is associated with at least one of: a magnet, a magnetic feature, and combinations thereof, wherein the second tracer additive is a different composition from the chemical additive, but is otherwise also in non-magnetic powder form, and has an average particle diameter of at least 0.1 μm to less than 1 μm.

5. The method of using the tracer additive of claim 4, wherein the target formation has an average permeability of 0.1 nanodarcy to 1000 nanodarcy.

6. The method of using the tracer additive of claim 5, wherein the target formation is part of a geothermal well, and the remnant fluid is used in an energy generation process.

7. A method of using a tracer additive in a wellbore, the method comprising:

forming a utility fluid mixture comprising the tracer additive;

disposing the utility fluid into the wellbore at a sufficient flow rate and pressure so that the utility fluid comes into contact with a target formation in communication with the wellbore;

upon contacting the utility fluid with the target formation for an amount of time, returning a remnant fluid that includes at least a portion of the utility fluid to a surface;

taking a sample of the remnant fluid;

providing the sample to a lab facility;

filtering the sample to provide a filtered sample;

testing the filtered sample at the lab facility via non-destructive energy dispersive x-ray fluorescence (EDXRF) in order to analyze the remnant fluid via energy excitation at sub-atomic level in order to provide a set of fluid data associated with an elemental composition of the remnant fluid; and from the same wellbore, disposing a second tracer additive into the wellbore so that the second tracer additive comes into contact with one or more of the target formation, another target formation proximate to the wellbore, or combinations thereof, wherein the tracer additive has a first tracer composition, wherein the tracer additive is in a non-magnetic solid powder form, wherein the second tracer additive is a different composition from the tracer additive, but is otherwise also in a non-magnetic powder form, wherein the set of data is used to establish flow mapping of the wellbore, wherein no step of the method uses or is associated with at least one of: a magnet, a magnetic feature, and combinations thereof, wherein the first tracer additive and the second tracer additive have a respective average bulk specific gravity of at least 0.6 to no more than 1.2, wherein the target formation is associated with a frac stage, wherein the wellbore is associated with a formation temperature of at least 450° F. to no more than 2000° F., wherein the target formation has an average permeability of 0.1 nanodarcy to 1000 nanodarcy, and wherein each of the first tracer additive and the second tracer additive have a respective average particle diameter of at least 0.1 μm to less than 1 μm.

* * * * *